United States Patent [19]

Enoksson

[11] 4,041,867

[45] Aug. 16, 1977

[54] CONDUCTOR CONTAINING EXPLOSIVE GAS MIXTURE FOR INITIATION OF IGNITION ELEMENT AND EXPLOSIVE CHARGE

[75] Inventor: Bertil Petrus Enoksson, Gyttorp, Sweden

[73] Assignee: Nitro Nobel AB, Gyttorp, Sweden

[21] Appl. No.: 640,953

[22] Filed: Apr. 12, 1976

[30] Foreign Application Priority Data

Dec. 20, 1974 Switzerland ..... 16111/74

[51] Int. Cl.[2] ..... C06C 5/04

[52] U.S. Cl. ..... 102/27 R; 102/29

[58] Field of Search ..... 102/22, 23, 27, 29

[56] References Cited

U.S. PATENT DOCUMENTS

| | | | |
|---|---|---|---|
| 3,590,739 | 7/1971 | Persson | 102/27 R |
| 3,597,919 | 8/1971 | Lilly | 102/27 R |
| 3,885,499 | 5/1975 | Hurley | 102/29 |
| 3,939,772 | 2/1976 | Zebree | 102/29 |

*Primary Examiner*—Verlin R. Pendegrass

*Attorney, Agent, or Firm*—Hane, Sullivan & Spiecens

[57] ABSTRACT

A tubular fuse, which is supplied with an explosive gas, is formed so that as the explosive gas is detonated a turbulence will be created to aid in the propogation and continuance of the detonation. To achieve this turbulence, the inner circumferential surface of the tubular fuse is roughened at least along a portion of the length of the fuse. Alternatively, turbulence may be created by coating the inner circumferential surface of the fuse with a fine-grained powder.

7 Claims, 2 Drawing Figures

Figure 1A:
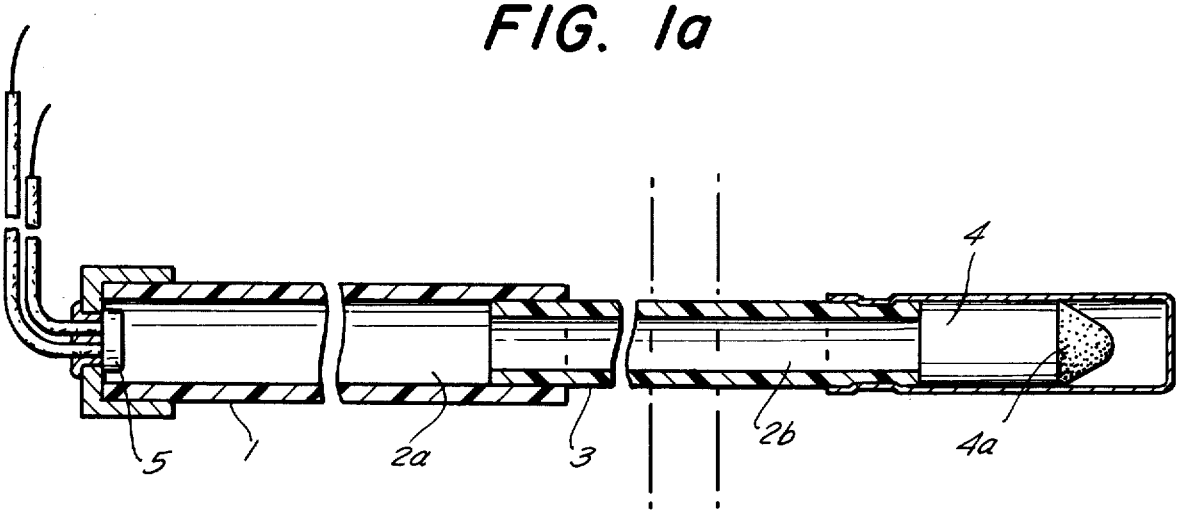

CONDUCTOR CONTAINING EXPLOSIVE GAS MIXTURE FOR INITIATION OF IGNITION ELEMENT AND EXPLOSIVE CHARGE

In all handling of explosives, consideration must be taken to how a detonation is transmitted from one place to another. The transmission can take place directly through a coherent string of explosive or it can take place via a shock wave in the medium surrounding the explosives. These two cases are well known, and investigated. They have contributed towards accidents, but have also been utilized in the practical used of explosives.

The transmission through tubes is difficult to judge. A closed channel conveys the shock wave and can make a transmission at a long distance possible. If the cross-section area is reduced, the losses are increased, and the transmission can be impeded.

A practical case can serve to illustrate the difficulties. Glycerol trinitrate was to be transported from one room to another, through a narrow hose. The glycerol nitrate was desensitized with the aid of a solvent, and such a small inner diameter of the hose was chosen that a detonation could not go through the liquid explosive. However, it proved that the empty hose, because of a thin film of explosive, could transmit the detonation. The detonation was transmitted with a speed of 2000 m/sec. The initiation of the thin film of liquid took place via the so-called channel effect, i.e. the shock wave which precedes the detonation wave starts the reaction of the glycerol nitrate. A change from air to nitrogen gas, it proved, did not have any influence on the process. This is natural, as the reaction takes place in an explosive, which is not dependent on the surrounding medium for its supply of energy.

It has been endeavoured to utilize this possibility of transmission via a thin layer of explosive, viz. for the designing of a type of detonating cord, shock tube. A hose is coated on the inside with powder or a high explosive. The shock wave passing through the channel starts an exothermic reaction in the powder on the walls. The powder or explosive with which the inner surface of the hose is coated is usually not oxygen balanced, and therefore a conversion can take place between the products formed from the explosive substance and the gas which is present in the channel. However, the detonation, i.e. the transmission, is independent of this chemical reaction, which is proved by the fact that the gas can be replaced by an inert gas which cannot react with the explosive substance or the products arising from this at the reaction in the hose.

The difference, in principle, between a detonating cord, the inner chamber of which is filled with an explosive in powder form without a channel through it and a shock tube, the inside of which is coated with an explosive, keeping a channel open, is not very great. In both cases it is a question of a detonation consisting of a shock wave supported by a reaction zone.

A single phase string of explosive can hardly have been utilized in a detonating cord. It is difficult to find an appropriate system, as the energy transmission from a shock wave to a homogenious medium, as a fluid, is less favourable than to a powder with many boundary surfaces. We can leave the solid and fluid explosives and consider the conditions in an explosive gas or a gas mixture. A stoichiometric mixture of hydrogen gas and oxygen in normal condition gave a detonation velocity of 2800 m/sec. At a mol relation of $H_2/O_2 = 8$ a stable detonation of 3500 m/sec. was measured. The initiation took place by means of a spark from a capacitor. Theoretically and experimentally it is possible to determine how the detonation velocity can be regulated through the choice to reacting substances, composition, the gas pressure, and the inner diameter of the tube. A particularly interesting fact is that it is possible to obtain velocities which are lower, to one half of the thermodynamically calculated values. The lower velocities have been obtained by roughing up the inner surface of the tube, or by inserting obstructions, e.g. in the form of a spiral. In contrast to this, the rough surface has an accelerating effect on the movement of a flash in the tube. This increase of the velocity is considerable, and it can be a question of a couple of 10th powers. The velocity of the flash can be increased from a few meters per second to several hundred meters per second. The rough surface can be of importance at the initiation, and can facilitate the transfer to a detonation.

There is no fundamental difference if the gas filling of the tube consists of a mixture of two gases which react with each other, or of a gaseous chemical compound which in itself is explosive, such as acetylene, or hydrazine.

A transmission via a detonating gas is an effect that has been known for a long time. This process can be heard, for instance, when a Bunsen flame goes back. The detonation in the gas mixture was described by Berthelot & Vielle and Mallard & Le Chatelier as early as in 1881. The detonation wave attains high velocities, from 1000 to 4000 m/sec. i.e. several times sonic speed, in the normal condition. On the basis of the situation in the normal condition, the detonation velocity in gases is quite independent of temperature and pressure. A higher gas pressure involves an increased density and, accordingly, a higher energy concentration and a higher detonation velocity. For $2H_2 + O_2$ the velocity increased 2 % when the pressure was increased from 1 atm. to 2. An increase of the temperature reduces the density and, accordingly, gives a reduction of the detonation velocity. For a mixture of $C_2H_4 + 2\ O_2$ at 10° C a detonation velocity of 2580 m/sec. has been measured. At an increase of the temperature to 100° C the velocity was reduced to 2540 m/sec. However, the detonation velocity depends to a great extent on the composition of the gas mixture. Outside of a certain range, the mixture cannot be caused to detonate. The lower limit for hydrogen gas and air is at 18 % hydrogen gas. This mixture can still propagate a combustion wave. The limit for combustion is at 10 % hydrogen gas. The upper limit for capability of detonating is at 60 % hydrogen gas, while the upper limit for combustion is at 75 % hydrogen gas. If the air is replaced by oxygen, the lower limit for capability of detonating is moved to 15 % hydrogen gas and the upper limit to 90 % hydrogen gas. Within this range, the detonation velocity increases nearly linearily from 1400 m/sec. at 15 % hydrogen gas to 3600 m/sec. at 90 % hydrogen gas mixed with oxygen.

It is thus well known that a detonation can be generated in a tube containing an explosive gas mixture and that this detonation can be transmitted through the tube. It is also known that turbulence in the explosive gas mixture promotes the transition from combustion to detonation, and that the detonation velocity can be increased through turbulence promoting measures. An increase of the diameter of the tube, e.g. through an insertion into a container with explosive gas has an impeding effect on the detonation, due to the fact that the shock energy is distributed over a larger area, and can have the effect that the detonation dies. Even for explosive gas mixtures certain difficulties will thus arise with an narrow tube with explosive gas for transmission of a detonation. The conditions become much more difficult with solid and liquid explosives, which are usually quite unaffected by a detonating gas mixture. Utilizing a detonation transmission with explosive gas has been prevented by the necessity of using altogether too sensitive substances as a receiver.

It has been proved that these difficulties can be overcome, and that a tube with explosive gas can be made to constitute a safe and reliable detonation transmitter. This is made possible through turbulence in the gas mixture just at the charge which is to be initiated.

The initiation of the gas mixture can take place in many ways. The process commences with a combustion, which under certain conditions is transformed into a detonation. The length of the combustion zone is dependent on the composition of the gas mixture, pressure, temperature, and is longer in a wide tube than in a narrow tube. A strong initiation, e.g. via a strong spark, reduces the distance to the start of the detonation. An exploder is still more efficient. If the tube is widened, the detonation can again be transformed into a combustion which, if the tube is sufficiently long, can again develop into a detonation. The pre-detonation period can also be influenced by additives. e.g. tetra-ethyl lead, which has an impeding effect on the transition into a detonation. However, small quantities of additives usually have little effect on the detonation velocity. An exception to this is $CO + O_2$ where the addition of water vapour has a reaction promoting effect on the setting of the equilibrium. The explosion energy of gas mixtures is utilized in practice in various types of engines. otherwise, it is endeavoured to avoid explosive gas mixtures. The object of the present invention is to utilize an explosive gas mixture at the initiation of an explosive charge.

A tube or a hose can be filled with an explosive gas mixture, e.g. oxyhydrogen gas. One end of the hose or tube can be initiated with an exploder, a fuse head, or a spark. It is also possible to ignite the gas, which after a certain length, develops into a detonation. It has now been proved that this detonation in the gas mixture, in turn, can initiate an exploder, an instantaneous exploder as well as an exploder with a delay device. It is thereby possible to use the tube or hose filled with oxyhydrogen gas as a fuse. Several other gas mixtures can come into question. Methane mixed with oxygen, $CH_4 + 2\ O_2$ gives a detonation velocity of 2150 m/sec. Carbon monoxide and oxygen, $2\ CO + O_2$ has a detonation velocity of 1260 m/sec. With 5 % $H_O$ the velocity is increased to 1730 m/sec. Acetylene can be used directly as it is, but can also be mixed with oxygen, as with $C_2H_2 + O_2$ a detonation velocity of 3000 m/sec. can be attained. The oxygen can be added together with nitrogen gas in air, and the velocities will be somewhat lower, but otherwise the fuse will function in the same way. The advantage of using oxygen is that the upper limit for the detonation is substantially higher than when air is used. While hydrogen and oxygen has a range of 15–90 % hydrogen this is reduced to 18–60 % hydrogen for a mixture of hydrogen and air. The fuse have a comparatively low energy content. It is possible to go particularly far in this direction by using certain organic compounds mixed with oxygen or air, for which the lower limit is at a couple of percent of combustible substance. A still lower development of effect is achieved by utilizing combustion instead of detonation in the explosive gas. The tube or hose can be closed at both ends. As the inner diameter is small, for practical conditions always less than 10 mm and usually less than 5 mm, there will be no inconvenient leakage of gases when the hose is handled during a short time. It is possible to work with an open hose. Another possibility is to fill the hose with the explosive gas mixture on the work site directly before use. It is possible to carry out the loading work with a hose which contains only air. This led to the blasting site, where it can be distributed to various lines by means of connection devices. One hose leads to the exploder down in the drill hole, and another runs from the exploder over to the exploder in the next hole. By filling the system with an explosive gas just before the blasting is to take place, the salvo can be initiated with the aid of the explosive mixture from a protected place. With a detonation velocity of more than 2000 m/sec. the delay in the fuse is insignificant, and interval exploders can be used, in the same way as when electric ignition is used. However, this system has the same disadvantage as the electron system, inasmuch as there must be two conductors to each exploder. They occupy space in the drill hole and, above all, they involve a risk for incorrect connections. It has now been proved to be possible to work with a tube system that has been filled in advance, by the hose with the explosive gas mixture being crimped tightly at the exploders and the connection of the ignition tubes from the different drill holes being made with a small exploder containing initiating means, whereby the hose will be closed everywhere. The ignition of the gas fuse can appropriately take place by means of an ignition charge which is inserted in the far end of the conductor which transmits the initiation to the blasting site, after which this end is closed gas tight.

The hoses that are inserted into the drill holes are consumed. According to the procedure stated herein, there is only one hose in each drill hole, whereby the cost of ignition hose is reduced, compared with the case when the explosive gas is inserted after the loading. In the same way, it is sufficient to have one single conductor to the explosive charge from the protected ignition position. It is an advantage to have the hose leading from the ignition position to the blasting site made with a larger diameter than the hose that is inserted into the drill holes. It corresponds to the ignition cable used for electric ignition and, as in the case of this, can be used a number of times. After a blasting operation, its tightness should be checked, damaged parts removed, and thereafter it should be spliced, if required, and filled with explosive gas. Under certain conditions it can be an advantage to fill this conductor corresponding to the ignition cable with explosive gas from the ignition position just before the blasting is to be carried out. A feed conductor and a return conductor can then be used, in order to be able to check that a sufficient quantity of gas has been filled in. It is more simple, and cheaper, to work which a hose which is open in the end that has been laid out to the blasting site, and so much gas being filled in that it will be ensured that it is sufficient to fill the conductor to the first exploder.

The explosive gas fuse is an excellent member for use in combination with shock tubes, as a conductor from the protected ignition position to the blasting site. It is thereby possible to overcome one difficulty with the shock tube, which is too expensive to be used for this purpose, as it cannot be refilled. Electric ignition can be used, but this fails to serve the purpose of the shock fuse, which has an essential purpose of avoiding risks of unintentional electric ignition. In this respect the fuse with explosive gas fulfils the same severe requirements as a shock tube in a nonelectric conducting material.

The explosive gas mixture can be caused to detonate directly with the aid of a fuse head or through ignition by a sufficiently violent shock wave. The gas can be ignited with a flame, for instance from a match. Depending on the composition of the gas and the inner diameter of the hose, the combustion will die, continue at a low speed, or develop into a detonation. The development into a detonation takes place through turbulence in the combustion zone, and this process can therefore be furthered by roughing the walls in the hose by means of rifling or the insertion of a powder. A larger diameter in the vicinity of the ignition point is also favourable, a smaller hose being used for the other parts, to keep the costs down, at the same time as the fuse is made easier to handle.

EXAMPLE 1

Figure 1B:
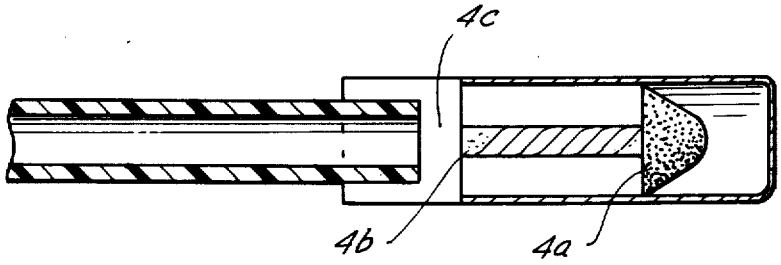

As it is shown in FIGS. 1*a* and 1*b* a polyvinyl chloride hose 1 with an inner diameter of 7 mm and an outer diameter of 10 mm was filled with a stoichiometric mixture of hydrogen and oxygen 2*a*. The hose was connected to another hose 3 with an inner diameter of 4 mm and an outer diameter of 7 mm, which was filled with the same explosive mixture 2*b* and the other end of which was inserted in an a detonator 4 which was crimped on the hose. The free end of the larger hose was initiated by means of a fuze head detonator 5. The detonation was transmitted to the detonator via the conductor. Trials were carried out with instantaneous detonators 4*c*(FIG. 1*A*), the detonation in the gas mixture then igniting lead azide 4*a*, as well as with detonators with delay devices 4*b*(FIG. 1*b*), the explosive gas mixture than igniting the delay composition 4*c* which, after the time set, initiated the lead azide in the exploders.

EXAMPLE 2

An ionomer polymer hose with an inner diameter of 3 mm was filled with a mixture of equal parts of acetylene and oxygen. Initiation took place at one end by means of an exploder. The detonation was conveyed through the hose, down into a drill hole, where an exploder crimped on to the other end was initiated.

EXAMPLE 3

The larger hose according to example 1 was moistened on the inside with benzene, and after a storage time of 10 min. the fuse was initiated with a fuse head. After the detonation, the inside of the hose was coated with a very fine-grained carbon powder. The hose was moistened anew on the inside with benzene, after which oxygen was fed through the hose. Initiation was carried out by means of an exploder. A detonation velocity of 3200 m/sec. was measured, and the reaction was clearly stronger than when air was used instead of oxygen.

EXAMPLE 4

When refilled, a hose that has previously been used with a gas mixture which leaves solid particles such as carbon powder is favourable for a development from combustion to detonation. The insertion of metal powder gives a still better effect. A hose with an inner diameter of 7 mm and an outer diameter of 10 mm was powdered on the inside with fine-grained aluminium, after which the hose was filled with hydrogen and oxygen in a mol relation of $H_2/O_2 = 8$. The gas was ignited with a match. The exothermic reaction in the hose started as a combustion, increased in velocity, and developed into a detonation with a velocity of 3500 m/sec.

EXAMPLE 5

A polyethylene hose with an inner diameter of 5 mm was filled with a stoichiometric mixture of hydrogen and oxygen, after which one end of it was put on to a shock tube with an inner diameter of 1.5 mm. The inside of the shock tube was powdered with fine-grained tetramethylene tetranitramine. The free end of the gas fuse was ignited with a match. The exothermic reaction in the gas mixture started the detonation in the shock fuse.

I claim:

1. In a tubular fuse for initiation of an ignition element, such as a detonation cap provided with a solid ignition substance, said tubular fuse being filled with an explosive gas, wherein the improvement comprises: means formed on at least a portion of the inner circumferential surface of said tubular fuse for creating turbulence of said explosive gas, the turbulence created by said means aiding in the propogation and continuation of a detonation of the explosive gas to the ignition element.

2. The improvement according to claim 1, wherein said means for creating turbulence comprises a powder coating said inner circumferential surface of said tubular fuse.

3. The improvement according to claim 2, wherein said powder is a fine-grained carbon powder.

4. The improvement according to claim 2, wherein said powder is a fine-grained aluminum powder.

5. The improvement according to claim 2, wherein said powder is a fine-grained tetramethylene tetranitramine powder.

6. The improvement according to claim 1, wherein said inner circumferential surface comprises a roughened surface, said roughened surface constituting said means for creating turbulence.

7. The improvement according to claim 1, wherein said means for creating turbulence of said explosive gas extends the whole length of said tubular fuse.

* * * * *